US007845101B2

(12) United States Patent
Padiak et al.

(10) Patent No.: US 7,845,101 B2
(45) Date of Patent: Dec. 7, 2010

(54) SELF-RETURNING HORIZONTAL SIGN SYSTEM

(75) Inventors: Scott Padiak, Skokie, IL (US); Thomas M. Conway, Park Ridge, IL (US); Paul C. Evans, Chicago, IL (US); Jeffrey C. Ouyang, Chicago, IL (US)

(73) Assignee: Cormark, Inc., Des Plaines, IL (US)

( * ) Notice: Subject to any disclaimer, the term of this patent is extended or adjusted under 35 U.S.C. 154(b) by 1369 days.

(21) Appl. No.: 11/306,726

(22) Filed: Jan. 9, 2006

(65) Prior Publication Data

US 2007/0209252 A1 Sep. 13, 2007

(51) Int. Cl.
*G09F 11/00* (2006.01)

(52) U.S. Cl. ..... 40/491; 40/606.07; 116/79; 49/404

(58) Field of Classification Search ..... 40/488, 40/487, 490, 491; 49/404; 16/79
See application file for complete search history.

(56) References Cited

U.S. PATENT DOCUMENTS 5,131,188 A * 7/1992 Hutchison et al. ..... 49/404
5,285,596 A * 2/1994 Kinsey ..... 49/404
7,124,469 B2 * 10/2006 Tsekhanovsky et al. ..... 16/79
7,430,832 B2 * 10/2008 Hung ..... 49/404
2004/0074046 A1 * 4/2004 Mimnaugh ..... 16/96 R
2006/0272215 A1 * 12/2006 Perron ..... 49/123
2006/0283564 A1 * 12/2006 Poppema ..... 160/371

* cited by examiner

*Primary Examiner*—Cassandra Davis
(74) *Attorney, Agent, or Firm*—Levenfeld Pearlstein, LLC

(57) ABSTRACT

A self-returning horizontal sign system mounts to an associated structure. The system sign includes an upper rail having front and rear, parallel, spaced apart tracks and a lower rail having front and rear, parallel, spaced apart tracks. A pair of panels extend between and span the upper and lower rails. Each panel has a carrier assembly mounted to an upper region thereof for cooperation with a respective front or rear track of the upper rail. The carrier assemblies have at least two rollers that are carried in the upper rail. The panels each move between an open position and a closed position. A closure formed as a pull box is associated each panel and includes a spool having a cable wrapped around it. The spool is rotatable to retract and extract the cable from about the spool. The closure includes a tension bias element operably connected to the spool to bias the spool to retract the cable. The cable is operably connected to the panel such that moving the panel from the closed position to the open position extracts the cable. The closure includes a rotating dampening element operably connected to the spool to dampen rotation of the spool when retracting the cable as the panel moves from the open position to the closed position.

15 Claims, 7 Drawing Sheets

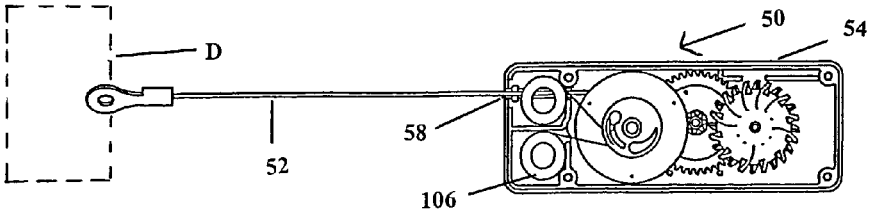
FIG. 8
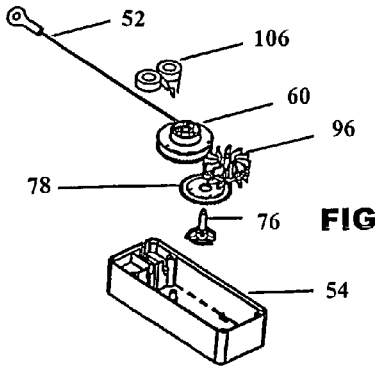
FIG. 10
FIG. 9
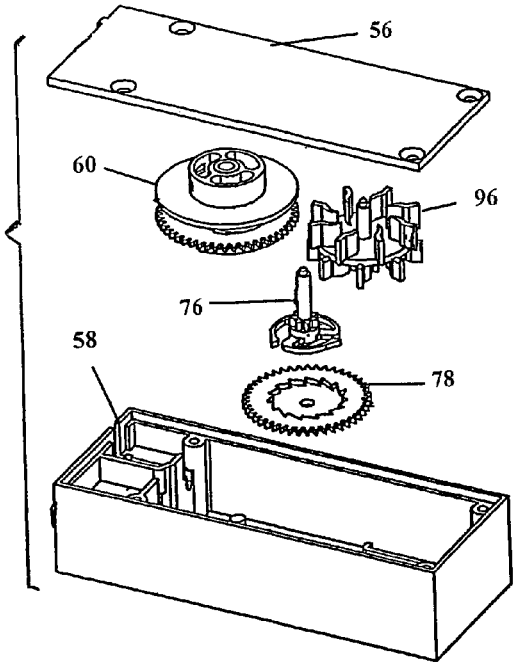
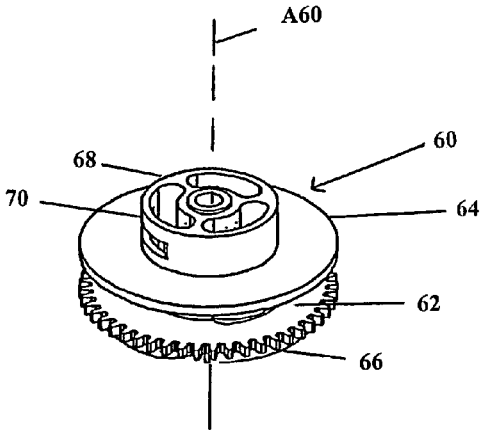
FIG. 11A
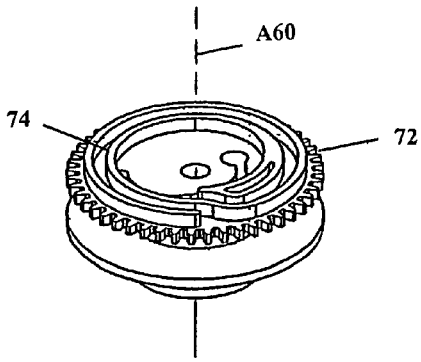
FIG. 11B

SELF-RETURNING HORIZONTAL SIGN SYSTEM

BACKGROUND OF THE INVENTION

The present invention is directed to a sign mount. More specifically, the present invention is directed to a horizontal sliding or rolling mount that has is self-returning.

Signs are used in all manner of display and merchandising. Many signs serve multiple purposes. For example, a sign can be used to attract a consumer's attention to a specific location or object. At the same time, such a sign can be used to overlie or cover a storage area. Sign serving this dual function are illustrated in Padiak et al., U.S. Pat. No. 6,701,575 and Conway et al., U.S. Pat. No. 6,470,611, both of which patents are commonly assigned herewith and incorporated by reference.

While both of these patents function quite well for their intended purposes, one drawback to each of these signs is that space to the side of (in the case of the '575 patent which pivots horizontally) and above (in the case of the '611 patent which slides vertically) is required for proper functioning of the sign.

In addition, these signs are of the type that remain in the open position after use. Again, in certain instances, an automatic closure is desired, and an arrangement in which the sign remains in place is not. This eliminates, for example, the need for a store employee to roam the store aisles closing the signs that are left open to "hide" the storage areas.

Moreover, many signs are not configured so as to permit varying the vertical height of the sign to "fit" a specific need. That is, man signs are of a standard height and/or require custom design in order to fill a particular need, for example, to fit between shelves that are a non-standard distance between them.

Accordingly, there is a need for a sign and mount that provides a covering over storage space. Desirably, such a sign provides a covering or overlay for storage space, without requiring surrounding space for moving the sign to an access position. More desirably, such a sign and mount is configured to automatically return to a closed position without prompting.

BRIEF SUMMARY OF THE INVENTION

A self-returning horizontal sign system mounts to an associated structure and provides a sign (or display) for covering storage space. The system provides a covering or overlay for storage space, without requiring surrounding space for moving the sign to an access position. The system is configured to automatically return to a closed position without prompting and can include a time delay to maintain the sign open for a period of time before the automatic return actuates.

The system includes an upper rail having front and rear, parallel, spaced apart tracks and a lower rail having front and rear, parallel, spaced apart tracks. A pair of panels extend between and span the upper and lower rails. Each panel has a carrier assembly mounted to an upper region for cooperation with a respective front or rear track of the upper rail. The carrier assemblies have at least two rollers that reside in the upper rail track.

A closure formed as a pull box is associated with at least one and preferably both of the panels. The closure includes a spool having a cable wrapped around it. The spool rotates to retract and extract the cable from the spool. The closure includes a tension bias element, such as a spring, that is operably connected to the spool to bias the spool to retract the cable.

The cable is operably connected to the panel such that moving the panel from the closed position to the open position extracts the cable. The closure includes a rotating dampening element that is operably connected to the spool to dampen rotation of the spool when retracting the cable as the panel moves from the open position to the closed position. A preferred dampening element is a bladed flywheel.

In a present system, the closure includes a one-way engaging element such that the spool engages the flywheel when the cable retracts and is disengaged from the flywheel when the cable is extracted from the spool. One form of engaging element is a ratchet drum and a ratchet pawl. The ratchet pawl is positioning in the ratchet drum. The pawl engages the spool and the drum engages the flywheel. Rotation of the pawl in one direction rotates the drum. Retraction of the cable rotates the spool which rotates the pawl and the drum which rotates the flywheel.

The closure can include a time delay assembly to delay retraction of the cable following extraction of the cable from the spool. This delays the closing of the panel after it is opened and released. The time delay assembly includes an interference element that is engageable with the flywheel to interfere with rotation of the flywheel, thus delaying retraction of the cable.

Other uses for the closure or pull box include the return of objects to a location adjacent to the box after the object has been pulled away.

These and other features and advantages of the present invention will be apparent from the following detailed description, in conjunction with the appended claims.

BRIEF DESCRIPTION OF THE SEVERAL VIEWS OF THE DRAWINGS

The benefits and advantages of the present invention will become more readily apparent to those of ordinary skill in the relevant art after reviewing the following detailed description and accompanying drawings, wherein:

FIG. 8 is a top view of the closure showing the cable partially pulled out from the closure;

FIG. 9 is an exploded perspective view of the closure;

FIG. 10 is an enlarged exploded view of the closure shown without the cable attached and without the springs;

FIGS. 11A and 11B are top and bottom perspective view of the closure spool;

DETAILED DESCRIPTION OF THE INVENTION

Figure 1:
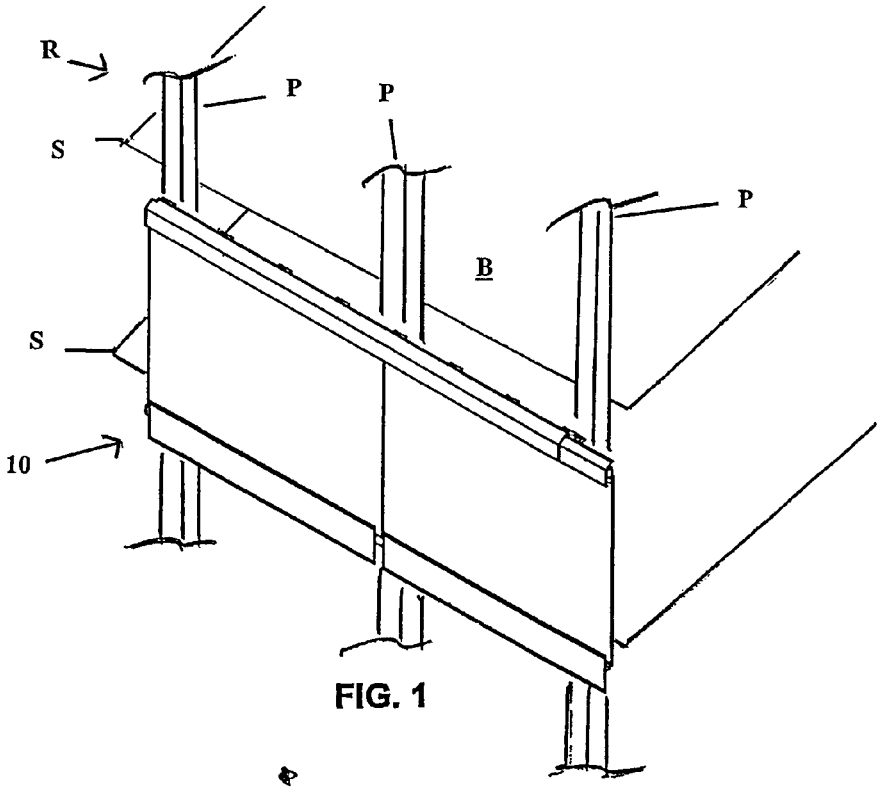
FIG. 1 is a perspective view of a self-returning sign system embodying the principles of the present invention, the sign system being illustrated mounted to a rack or storage system.

While the present invention is susceptible of embodiment in various forms, there is shown in the drawings and will hereinafter be described a presently preferred embodiment with the understanding that the present disclosure is to be considered an exemplification of the invention and is not intended to limit the invention to the specific embodiment illustrated.

It should be further understood that the title of this section of this specification, namely, "Detailed Description Of The Invention", relates to a requirement of the United States Patent Office, and does not imply, nor should be inferred to limit the subject matter disclosed herein.

Referring now to the figures, and in particular to FIG. 1, there is shown an embodiment of a self-returning horizontal sign mount system 10. The sign system 10 includes a pair sign sections 12 in a side-by-side arrangement with one of the sections 12*a* slightly forward of the other section 12*b* (see, e.g., FIG. 2). In this manner, the sign sections 12*a,b* can move horizontally relative to one another with one sign 12*a* in front and one sign 12*b* to the rear of the other. As will be appreciated by those skilled in the art, this arrangement permits access to about one-half of the space behind the sign 12 without requiring additional space to rotate (pivot) or raise (or lower) a sign section or door. Rather, all that is required vis-á-vis additional space is that attributed to the thickness of the sign sections 12*a,b* and the rails and other components which, as will be discussed below, is minimal.

The signs sections (or graphic panels 12*a,b*) are mounted between an upper rail 14 and a lower rail 16 which are in turn mounted to the pallet rack or storage rack R, typically at a shelf S. The rails 14, 16 are configured to capture and secure the panels 12*a,b* so that the panels 12*a,b* cannot swing forward and rearward from the rack R. In this manner, the panels 12*a,b* are maintained so that they can only slide along and between the rails 14, 16.

The front panel 12*a* is mounted to the upper rail 14 by one or more front carrier assemblies 18 and the rear panel 12*b* is mounted to the upper rail 14 by one or more rear carrier assemblies 20. The front and rear assemblies 18, 20 each include a bracket 22 and a pair of rollers 24 at about the ends of the assemblies 18, 20.

The upper rail 14 is formed having front and rear tracks or channels 26, 28 that receive the carrier assembly rollers 24. The tracks 26, 28 have a lower curved surface 30 to accommodate the rollers 24. An upper retaining wall 32 is positioned above the tracks 26, 28 and depending lips 34 extend from the upper retaining wall 32 (at the front and rear) to prevent the rollers 24 from "jumping" the tracks 26, 28. In this manner, the tracks 26, 28 maintain the carriers 18, 20 fixed which maintains the panels 12*a,b* parallel to one another and properly positioned in the rails 14, 16. A graphic cover 36 can also be affixed to the upper rail 14 to conceal the rail 14 and the carrier assemblies 18, 20. The upper rail 14 is mounted to the shelf S by mounting brackets 38. Each bracket 38 is affixed to the shelf S by fastener (not shown) and the rail 14 is mounted to the bracket 38 by a fastener (not shown) that inserts through an opening 40 in the front of the bracket 38.

The lower rail 16, like the upper rail 14 is configured with front and rear tracks or channels 42, 44 that are configured to receive the panels 12*a,b*. In this manner, with the panels 12*a,b* secured from above and below in the rails 14, 16 the panels 12*a,b* are well captured and permitted only to slide along the rails 14, 16 to open and close access to the storage area behind the sign panels 12*a,b*. Similar to the upper rail 14, the lower rail 16 can have a graphic or cover 46 mounted thereto to conceal the rail 16.

To provide the motive force to return the panels 12*a,b* to the closed position, the system 10 includes a pair of biased (sprung) dampened closures 50, one associated with each of the panels 12*a,b*. The closures 50 are operably connected to their respective doors 12*a* or *b* by a cable 52. The closures 50 include a housing 54 having a cover 56. An opening 58 in the side of the housing 54 accommodates the cable 52 passing into the housing 54.

A spool 60 is positioned in the housing 54 and has a cable channel 62 for winding the cable 52 onto the spool 60. The channel 62 is defined by an upper retaining flange 64 and a lower geared walled 66. The spool 60 defines an axis of rotation A60. An upper sleeve 68 on the spool 60 has a slotted wall 70 and a lower surface 72 of the spool 60 (below the geared surface 66) defines a pin track 74 that traverses around the surface in an inwardly spiraling profile as best seen in FIG. 11B.

Adjacent to the spool 60, the closure 50 includes a ratchet pawl 76 and a ratchet drum 78. The ratchet pawl 76 includes a 80 pin that defines an axis of rotation A76 that is spaced from the spool axis A60. The pawl 76 includes a plurality (three as shown) of flexible fingers 82 that extend outwardly from the axis A76 and bend or curve to define a periphery. Each finger 82 has a detent 84 at about the end thereof. The pawl 76 fits into a toothed depression 86 in the drum 78 with the pawl fingers 82 movable in one-direction (as indicated at 88) in the drum 78. The drum inner teeth 90 are asymmetrical, having a steeply sloped side 90*a* and a lesser sloped side 90*b*. In this manner, when the pawl 76 rotates clockwise relative to the drum 78, the fingers 82 can "slip" over the drum inner teeth 90 (ramping along the lesser sloped sides 90*b*); however, when the pawl 76 rotates counterclockwise relative to the drum 78, the pawl finger detents 84 engage the steeply sloped sides 90*a* of the teeth and prevent the pawl 76 from rotating (without rotating the drum 78). The ratchet pawl 76 includes a geared projection 92 extending upwardly from about the pin 80. The projection 92 is configured and positioned to cooperate with the geared surface 66 of the spool 60. Thus, rotation of the spool 60 rotates the pawl 76 and can rotate the drum 78 (depending upon the direction of rotation). The drum 78 also includes a geared outer surface 94.

A flywheel 96 is positioned in the closure 60 adjacent the pawl 76 and drum 78. The flywheel 96 includes a plurality of blades 98 that extend radially outwardly from an axis A96 of the flywheel 96 and extend longitudinally in two (opposite) directions D1, D2 along the axis A96. The blades 98 define two "sets" one 98*a* on one side of the central disk or support 100 and the other set 98*b* on the other side of the disk 100. A geared hub 102 extends along the axis A96 from one side of the central disk 100. The hub gear 102 is configured to cooperate with the drum geared outer surface 94 such that rotation of the drum 78 rotates the flywheel 96. The blades 98 are formed having curved surfaces, essentially having a concave profile in the direction of damping rotation (as indicated by the arrow at 104). The curved profile of the flywheel blades 98 is configured to create wind resistance as the flywheel 96 rotates.

The closure 50 includes at least one and in a present embodiment, a pair of biasing elements, such as the illustrated springs 106 that provide the motive force for closing the panels 12*a,b*. The springs 106 are of the flat coil or spiral type, as illustrated in FIG. 9.

In operation, as the panel 12*a* or b is opened, the cable 52 of the closure 50 (which is mounted on a side of the panel in the closed position), is pulled from the spool 60 through the housing opening 58. As the cable 52 is pulled, the spool 60 rotates counterclockwise (as seen in FIG. 8). This in turn pulls the springs 106 from the coiled state, tensioning the springs 106. The springs 106 wrap around the upper sleeve 68.

As the spool 60 rotates counterclockwise, the gear teeth 66 engage the pawl geared projection 92 to rotate the pawl 76 clockwise (opposite of the spool 60). However, because the pawl 76 is a one-way driving element, as it rotates in the clockwise direction, it does not (or may not) rotate the pawl drum 78. Rather, the pawl fingers 82 (can) slip over the drum teeth 90. As such, the flywheel 96 may, but does not have to, rotate. The tension in the springs 106 on the spool 60 maintains tension in the cable 52 as it is pulled from the closure 50.

After the panel 12*a* or b has been opened and is subsequently released, the spring 106 tension rotates the spool 60 clockwise (to rewind the cable 52). This in turn rotates the pawl 76 counterclockwise. As the pawl 76 rotates counterclockwise, the pawl fingers 82 engage the steeply sloped sides 90*a* of the drum inner teeth 90 which rotates the drum 78 counterclockwise. As the drum 78 rotates counterclockwise, the gear teeth 94 on the periphery of the drum 78 engage the hub gear 102 on the flywheel 96 which rotates the flywheel 96. As the speed of the rotating flywheel 96 increases, the resistance (due to the flywheel blades 98) increases, thus slowing or dampening rotation of the flywheel 96 and in turn, dampening return of the panel 12*a* or b to the closed position. In addition to rotation of the flywheel 96, the weight of the panel 12*a* or b and the gear 66/92/94/102 ratios also facilitate dampening return of the panel 12*a* or b to the closed position.

Figure 15:
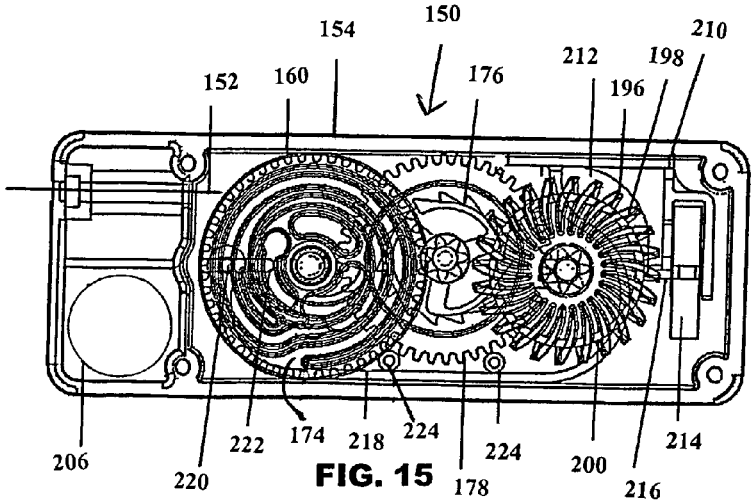
FIG. 15 is a wire frame drawing of an alternate embodiment of the closure that includes a time delay mechanism.

An alternate embodiment of the closure 150 is illustrated in wire frame format in FIG. 15. This embodiment of the closure 150 is configured to provide an apparent time delay prior to closure. It is an apparent time delay in that although the closure 150 is in fact rewinding the cable 152 (rotating the spool 160 clockwise), it is doing so at such a slow rotational speed that it appears to effect a delay prior to commencing (reverse or rewind) rotation. In this embodiment, a time delay assembly 210 is mounted to the housing 154 to engage the central disk portion 200 of the flywheel 196.

The delay assembly 210 includes a yoke 212 that is mounted to an inner wall of the housing 154 and a foliot 214 (or weight) mounted to the yoke 212. The foliot 214 has a disk-like shape and a nipple 216 extends from the end of the foliot 214 at the juncture with the yoke 212. The nipple 216 extends toward and into the space between the flywheel blade sets 198*a*, 198*b*, toward the central support disk 200.

A yoke arm 218 extends from the yoke 212 to the spool 160. The arm 218 is positioned behind the flywheel 196 (although it appears to run through the wheel in FIG. 15). A pin 220 mounts an end of the yoke arm 218 to the spool and to a longitudinal track 222 (in the form of a slot) in the housing 154. The pin 220 extends through the housing slot 222, though the yoke arm 218 end and into the spiral pin track 176 in the rear (or back) of the spool 160. In this manner, the arm 218 moves longitudinally back and forth (and moves the yoke 212 and foliot 214 longitudinally back and forth) toward and away from flywheel 196 as described below. The arm 218 is maintained in place laterally by retaining pins 224 in the housing 154.

In operation, as the cable 152 is pulled from the spool 160, the spool 160, pawl 176, drum 178 and flywheel 196 all rotate and function as described above. However, as the spool 160 rotates counterclockwise (as the cable 152 is pulled from the closure 150), the pin 220 moves along both the housing slot 222 and the spiral pin track 176 away from the center of the spool 160 and toward the periphery (to the left as seen in FIG. 15). This movement draws the foliot nipple 216 inward, toward the flywheel central disk 200, between the blade sets 198*a*, 198*b*.

In this configuration, after the panel 12*a* or 12*b* has been opened and is subsequently released, the spring 106 tension rotates the spool 160 clockwise, which in turn rotates the pawl 176 counterclockwise, which in turn rotates the flywheel 196. However, the foliot nipple 216 which is now in the space between the blades 198*a*, 198*b* interferes with rotation of the flywheel 196 (by contacting the blades 198), thus impeding rewind of the cable 152. As such, the spool 160 rotates slowly, and rewind is delayed or appears to be delayed until the spool 160 rotates sufficiently for the pin 220 to move to the right (toward the center of the spool 160), which in turn moves the foliot nipple 216 out from between the flywheel blades 198*a, b*. Effectively, the foliot nipple 216 moving between the blades 198*a,b* to initially interfere with rotation of the flywheel 196 provides an apparent delay in return action of the panel 12*a* or b.

Those skilled in the art will recognize that the present closure 50 is formed as a pull box. Such an element has a wide variety of uses, for example, as a return or retaining element for product in a retail environment. In such a use, the cable 52 can be attached to a product D (see for example, FIG. 8) and the pull box 50 (the housing 14) attached to a fixture such as a shelf. When the product D is pulled away from the box 50, the cable 52 is tensioned. When the product is released, the rewind action of the cable 52 pulls or returns the product D to the box 50 or fixture.

Figure 16:
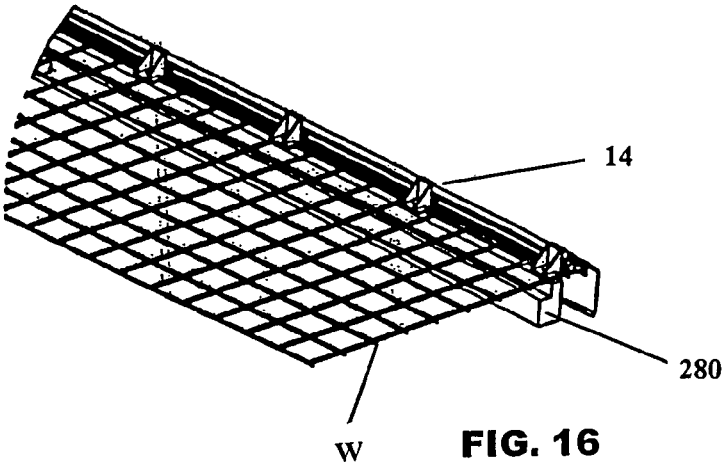
FIG. 16 is a perspective view of a wire shelf having the self-returning sign system mounted thereto.
Figure 17:
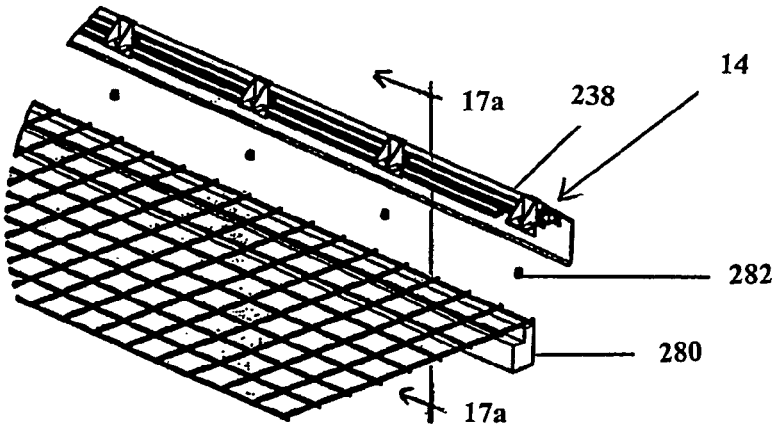
FIG. 17 is an exploded perspective view of the wire shelf with self-returning sign system mounted thereto.
Figure 17A:
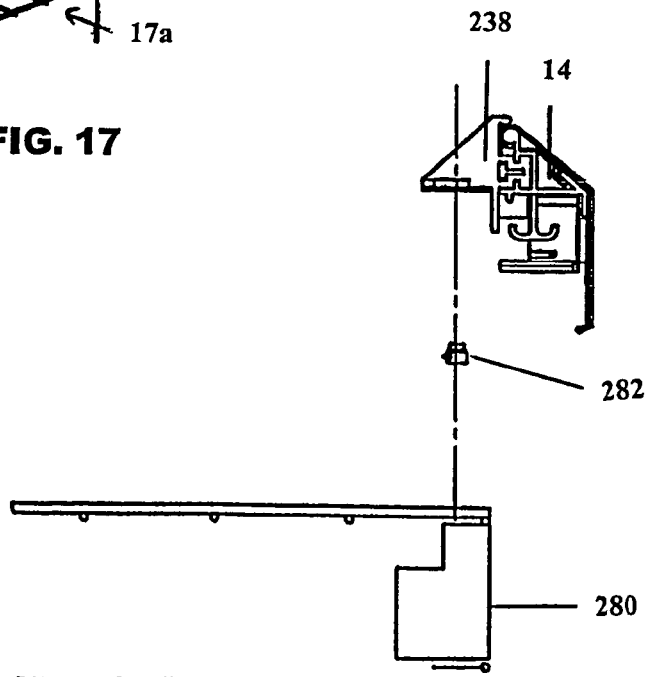
FIG. 17A is a cross-sectional view taken along line 17A-17A of FIG. 17.

FIGS. 16-17A show the sign mount system mounted to a wire shelf W. Typically in such a mounting arrangement, the wire W (in a rack or grid configuration) is mounted to an edge block 280. A spacer 282 is positioned between the bracket 238 and the block 280 through which a fastener (not shown) is inserted into the block 280. In this manner, the bracket 238 is securely mounted to the block 280, rather than possibly resting on the shelf wire W and mounting the system 10 askew.

Figure 2:
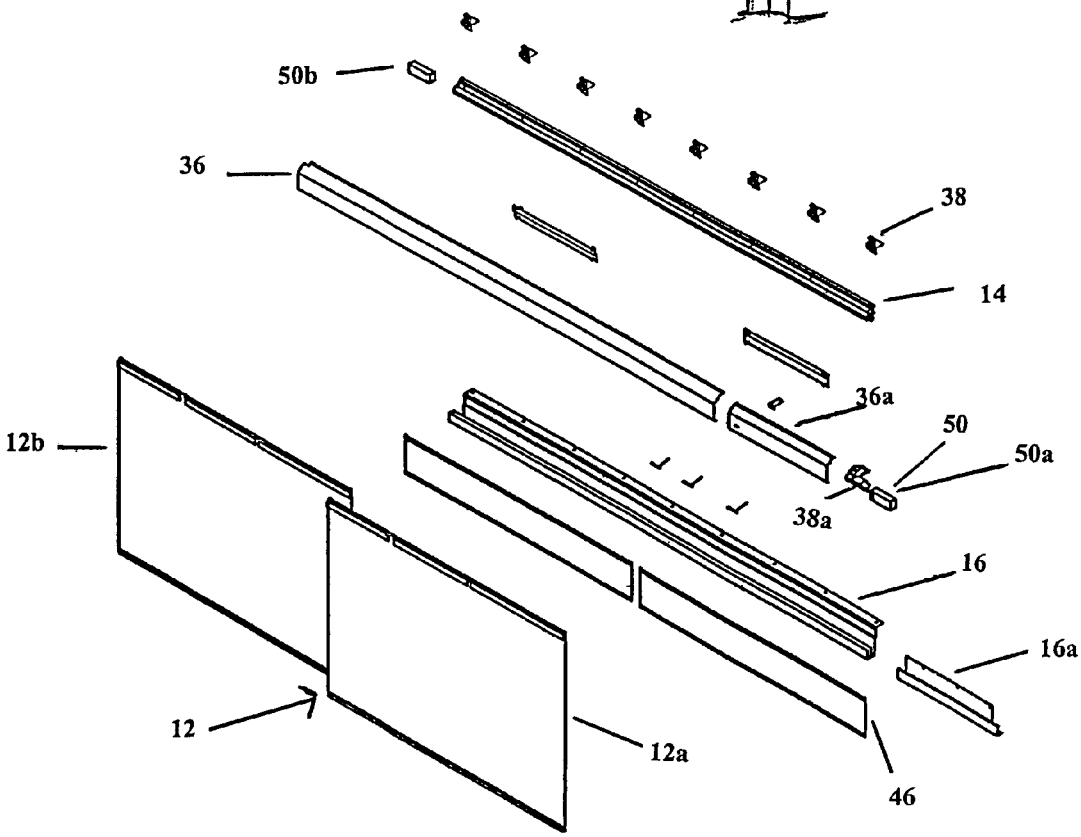
FIG. 2 is an exploded view of the sign system.
Figure 3:
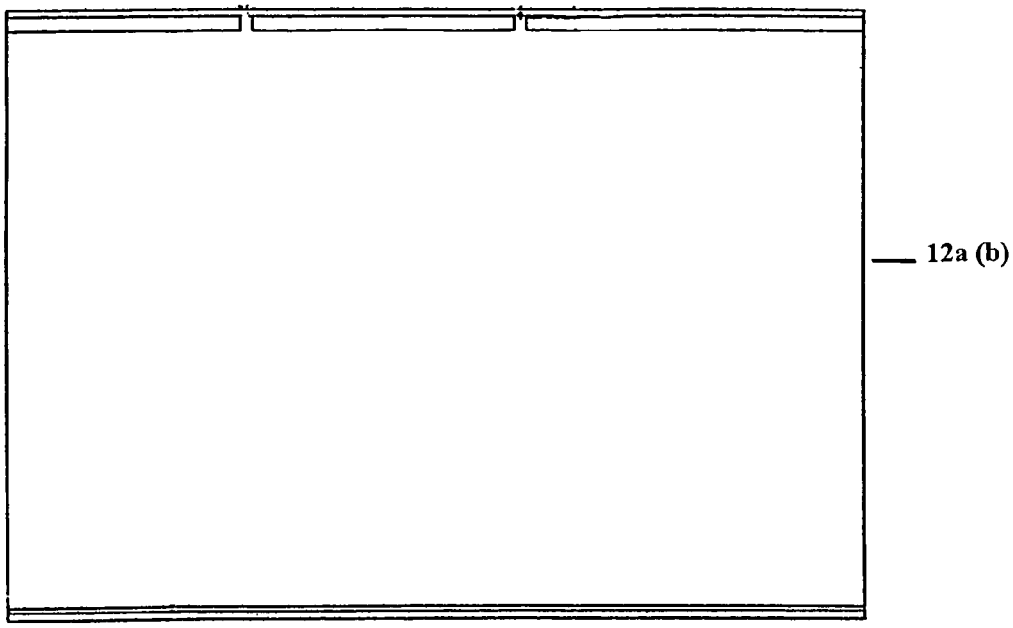
FIG. 3 is a front view of an exemplary sign panel.
Figure 4B:
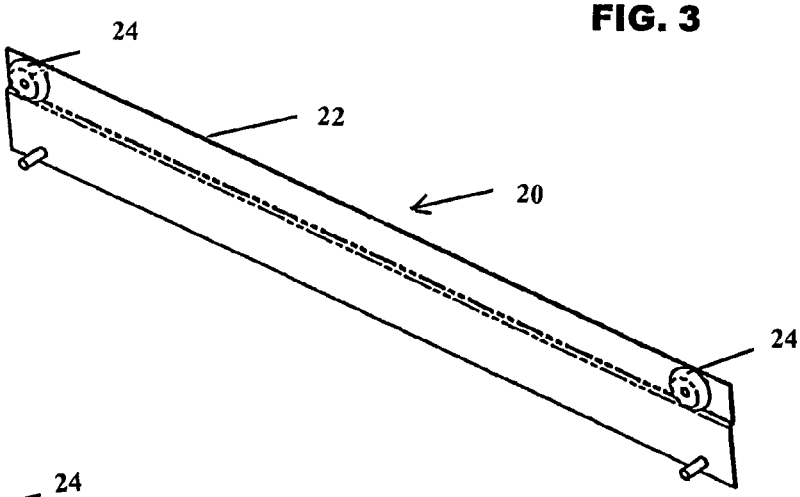
FIGS. 4A and 4B are perspective views of the front and rear carrier assemblies.
Figure 4A:
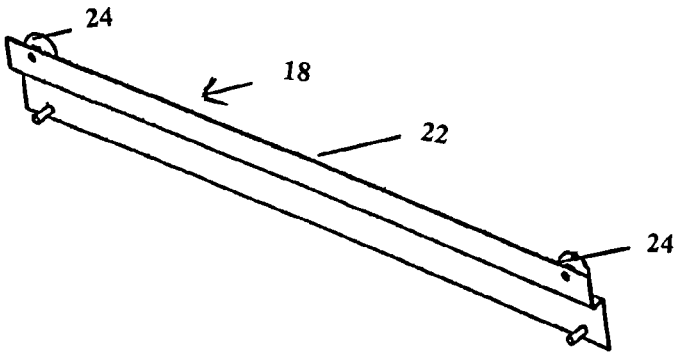
Figure 5:
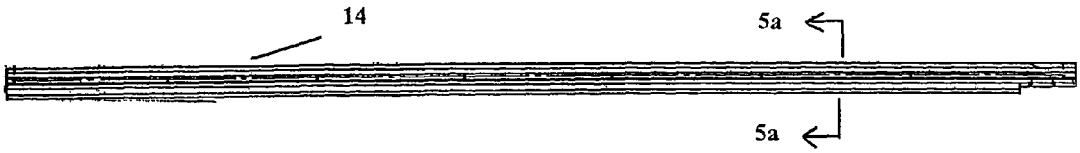
FIG. 5 is a front view of the upper rail.
Figure 5A:
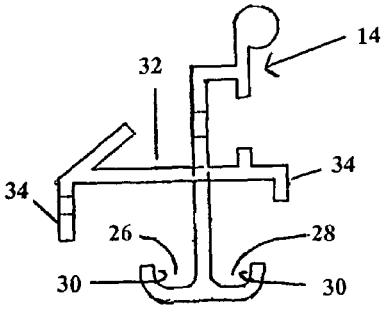
FIG. 5A is cross-sectional view taken along line 5A-5A of FIG. 5.
Figure 6A:
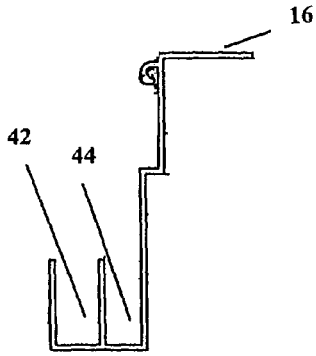
FIG. 6A is cross-sectional view taken along line 6A-6A of FIG. 6.
Figure 6:
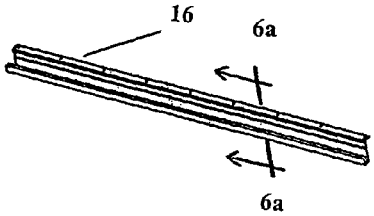
FIG. 6 is a front view of the lower rail.
Figure 7A:
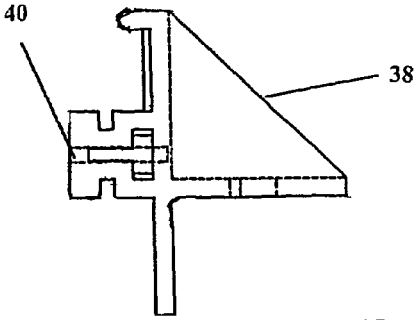
FIG. 7A is a side view of the bracket.
Figure 7:
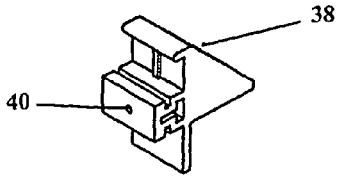
FIG. 7 is a perspective view of a rail bracket for mounting the upper rail to the shelf.
Figure 12:
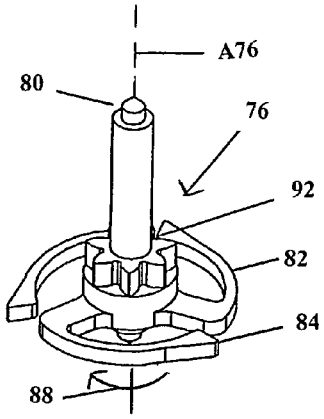
FIG. 12 is a perspective view of the closure ratchet pawl.
Figure 13:
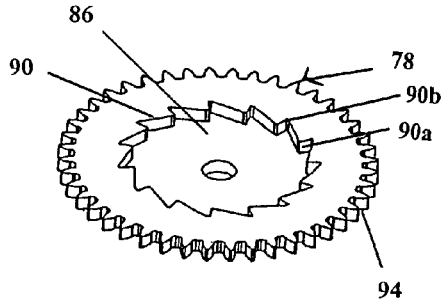
FIG. 13 is a perspective view of the ratchet drum.
Figure 14A:
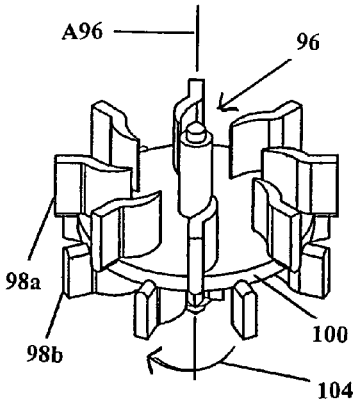
FIGS. 14A-14C are top perspective, side and bottom views of the closure fly.
Figure 14B:
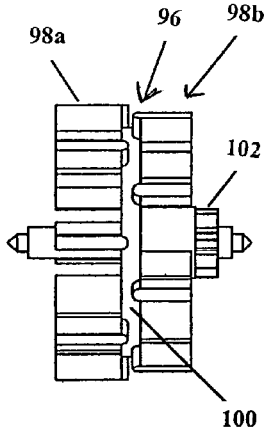
Figure 14C:
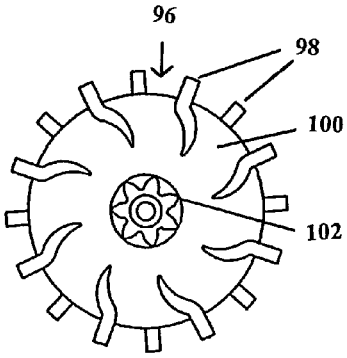
Figure 18:
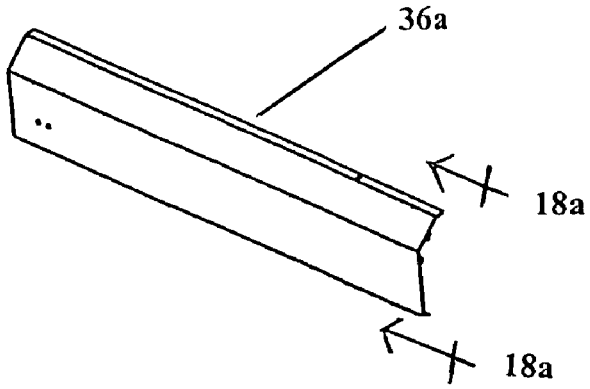
FIG. 18 is a perspective view of the upper extension cover.
Figure 18A:
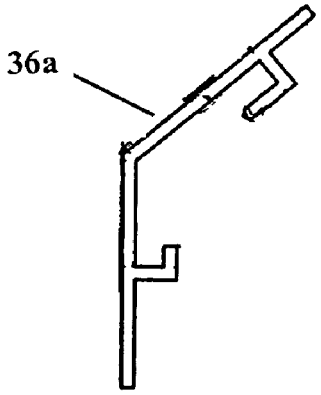
FIG. 18A is a cross-sectional view taken along line 18A-18A of FIG. 18.
Figure 19:
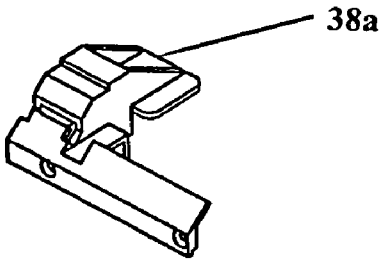
FIG. 19 is a perspective view of the upper extension bracket.

FIGS. 18 and 18A illustrate the upper extension cover 36*a* which, as can be seen in FIGS. 1 and 2 resides at one end of the upper graphic 36. The extension cover 36*a* like the upper graphic 36 serves to cover or overlie the upper rail 14. The extension cover 36*a* is secured to the upper rail by an extension bracket 38*a* that serves two functions. First, the bracket 38*a* secures to cover to the rail 14. Second, the upper extension bracket 38*a* serves as a stop for the panels 12*a*, 12*b*, to prevent the panels from over-traveling and running off of the rail 14. This is particularly important in that the system 10 is configured for use with storage systems R having bays B of different widths. That is, the distance between the upright vertical posts P (which defines a bay), can be different from one installation to another.

As such, the sign mounting system 10 must be able to be accommodated in bays B of different widths. This is accomplished by, for example, installing the upper rail 14 in a left justified manner (setting it too the far left) and installing the extension bracket 38*a* at the (desired) right most point of the panels 12*a*, 12*b*. In this manner, the right panel 12*a* is stopped from over-traveling to the right by the right panel closure 50*a* and the extension bracket 38*a*, and the left panel 12*b* is prevented from over-travel to the right by the extension bracket 38*a*. The bottom rail 16 also includes a corresponding extension piece 16*a* to accommodate panels 12*a*, 12*b* full travel within the system 10 within the bay B.

All patents referred to herein, are hereby incorporated herein by reference, whether or not specifically done so within the text of this disclosure.

In the present disclosure, the words "a" or "an" are to be taken to include both the singular and the plural. Conversely, any reference to plural items shall, where appropriate, include the singular.

From the foregoing it will be observed that numerous modifications and variations can be effectuated without departing from the true spirit and scope of the novel concepts of the present invention. It is to be understood that no limitation with respect to the specific embodiments illustrated is intended or should be inferred. The disclosure is intended to cover all such modifications as fall within the scope of the disclosed, exemplary embodiment.

What is claimed is:

1. A self-returning horizontal sign system for mounting to an associated structure, comprising:

an upper rail having front and rear, parallel, spaced apart tracks;

a lower rail having front and rear, parallel, spaced apart tracks;

a pair of panels, each extending between and spanning the upper and lower rails, each panel having a carrier assembly mounted to an upper region thereof for cooperation with a respective front or rear track of the upper rail, the carrier assembly having at least two rollers thereon carried in the respective front or rear track of the upper rail, each panel residing in a respective front or rear track of the lower rail, the panel each movable between an open position and a closed position, the open and closed positions of each panel being opposite of the other panel;

a closure associated with one of the panels, the closure including a spool having a cable wrapped therearound, the spool being rotatable to retract and extract the cable from about the spool, the closure including a tension bias element operably connected to the spool to bias the spool to retract the cable, the cable being operably connected to the panel such that moving the panel from the closed position to the open position extracts the cable, the closure including a rotating dampening element operably connected to the spool to dampen rotation of the spool when retracting the cable as the panel moves from the open position to the closed position.

2. The self-returning horizontal sign system in accordance with claim 1 wherein the closure includes an engaging element such that the spool rotationally engages the dampening element when the cable retracts and such that the spool is rotationally disengaged from the dampening element when the cable is extracted from the spool.

3. The self-returning horizontal sign system in accordance with claim 2 wherein the engaging element is a one-way engaging element.

4. The self-returning horizontal sign system in accordance with claim 3 wherein the one-way engaging element includes a ratchet drum and a ratchet pawl, the ratchet pawl disposed in the ratchet drum and for one-way rotation with the ratchet drum, the ratchet pawl being engaged with the spool and the ratchet drum being engaged with the dampening element and wherein rotation of the ratchet pawl in one direction rotates the ratchet drum, and wherein retraction of the cable rotates the spool which rotates the ratchet pawl and the ratchet drum which rotates the dampening element.

5. The self-returning horizontal sign system in accordance with claim 1 wherein the dampening element is formed as a flywheel having an axis of rotation and including longitudinally and radially extending blades.

6. The self-returning horizontal sign system in accordance with claim 5 wherein the flywheel is configured having a central support disk and including a first set of blades extending longitudinally from a first side of the central support disk and a second set of blades extending longitudinally from a second side of the central support, opposite the first set of blades.

7. The self-returning horizontal sign system in accordance with claim 6 including a time delay assembly to delay refraction of the cable following extraction of the cable from the spool, wherein the time delay assembly includes an interference element engageable with the flywheel between the first and second sets of blade in a plane defined by the central support disk.

8. The self-returning horizontal sign system in accordance with claim 7 wherein the closure includes a slot formed therein, wherein the time delay assembly is operably connected to the spool to actuate the time delay when the spool is rotated to extract the cable to delay reverse rotation of the spool and retraction of the cable.

9. The self-returning horizontal sign system in accordance with claim 8 wherein the time delay assembly moves longitudinally toward and away from the flywheel to actuate and disengage from the flywheel.

10. The self-returning horizontal sign system in accordance with claim 6 wherein one or both of the first and second sets of blades have a curved profile.

11. The self-returning horizontal sign system in accordance with claim 10 wherein the curved profile is a concave curve.

12. The self-returning horizontal sign system in accordance with claim 1 wherein the tension bias element is a spring.

13. The self-returning horizontal sign system in accordance with claim 12 wherein the spring is a flat coil spring.

14. The self-returning horizontal sign system in accordance with claim 13 wherein the closure includes two flat coil springs.

15. The self-returning horizontal sign system in accordance with claim 1 including a time delay assembly to delay retraction of the cable following extraction of the cable from the spool.

* * * * *